US005531148A

United States Patent [19]

Wilson

[11] Patent Number: 5,531,148

[45] Date of Patent: Jul. 2, 1996

[54] AUTOMATIC SET-UP, COLLAPSIBLE ELECTRONIC DRUM SET

[76] Inventor: Robert Wilson, P.O. Box 97, Hoopeston, Ill. 60942

[21] Appl. No.: 492,269

[22] Filed: Jun. 19, 1995

[51] Int. Cl.[6] ..... G10D 13/02

[52] U.S. Cl. ..... 84/412; 84/421; 84/DIG. 12

[58] Field of Search ..... 84/411 R, 421, 84/DIG. 12, 412

[56] References Cited

U.S. PATENT DOCUMENTS

| | | | |
|---|---|---|---|
| 3,264,926 | 9/1966 | Belli | 84/411 R |
| 3,433,115 | 3/1969 | Kjelstrom | 84/411 |
| 4,126,075 | 11/1978 | Kurosaki | 84/421 |
| 4,479,414 | 10/1984 | Willis | 84/421 |
| 4,691,611 | 9/1987 | May | 84/421 |
| 4,841,830 | 6/1989 | Yamashita | 84/422.1 |
| 5,076,131 | 12/1991 | Patterson | 84/421 |
| 5,140,889 | 9/1992 | Segan et al. | 84/411 R |

*Primary Examiner*—Patrick J. Stanzione
*Attorney, Agent, or Firm*—Schmeiser, Olsen & Watts

[57] ABSTRACT

An automatic set-up, collapsible drum set comprising a base, an upright, and a swing arm assembly each of which is hingedly connected to the next. A seat assembly, a locking mechanism, and a stick compartment are optionally provided so that the percussionist need only carry the drum set and a removable seat. Once the initial adjustments have been made for a given drummer, the drum set needs no further re-adjustment even after collapsing and re-setting-up the drum set.

11 Claims, 7 Drawing Sheets

AUTOMATIC SET-UP, COLLAPSIBLE ELECTRONIC DRUM SET

The present invention relates to a drum set, and, more particularly, to an electronic drum set that is collapsible and that may be automatically set-up into a predetermined playing position.

BACKGROUND OF THE INVENTION

Drum sets are regularly used by percussionists in various types of music. It is often necessary to move these drum sets from location to location for gigs, concerts, practice or recording sessions. This process can be difficult because of the bulkiness of the pieces and time consuming because of the large number of individual pieces which need to be moved and then reset to the drummer or percussionist's specifications. In an attempt to facilitate this process, various steps have been taken to reduce the number of individual pieces involved and the space needed to accomodate them, and as a result, reduce the amount of time incurred in the move. The following patents illustrate such attempts.

Kjelstrom U.S. Pat. No. 3,433,115 discloses a collapsible support structure that permits the drum stand to be dismantled into relatively small pieces for transportation and storage. Specifically, the collapsible support structure includes a stanchion extending upward from a base structure, a support head on the upper end of the stanchion, and an array of percussion instruments carried by the support head. Advantageuosly, the drum stand may be dismantled into parts that are small enough to fit into a relatively small carrying case, however, the drum heads must still be carried separately to move the entire set. Also, a great deal of time is needed to break down and set-up the drum set.

Willis U.S. Pat. No. 4,479,414 discloses a foldable drum support assembly having a pair of support frames hinged to a center post. The support frames may be folded toward one another to assume the storage or travel position. When in use, a set of bass drums must be in place on the support frames. These may be removed during the storage and travel periods. The additional drum heads and/or cymbals must be removed, separately packaged, transferred, and replaced resulting in numerous individual cases to be tranferred and a great deal of time for the percussionist to break down and set-up.

May U.S. Pat. No. 4,691,611 discloses an electronic percussion instrument including a base supporting a plurality of percussion heads on removable standards. The bottom section of each standard is seated within a rotatable, spherical support. The upper portion of each standard is designed to receive one of the percussion heads thereon. For transportation and/or storage, the seat and each of the percussion heads must be manually removed and placed within compartments in the base. Each of the standards retracts into the base and the base itself folds in half. Although this system is more compact than those previously described, a great deal of time is still required for breaking down and reassembling the set.

Battle U.S. Pat. No. 5,063,821 discloses a mounting arrangement for percussion instruments. The instrument uses a set of tubular drums mounted on supporting devices which are in turn supported by vertical supporting rods. This mounting arrangement is adjusted upon the initial set-up and then is left in one place unless it is mandatory to move it, in which case a great deal of time and effort is needed.

SUMMARY OF THE INVENTION

The present invention is directed to a self-contained, drum set, and more particularly, an automatic set-up, collapsible drum set. The set is adjusted upon initial set-up and may then be collapsed, moved and set-up repeatedly without the need for further adjustment.

The drum set includes a support frame, which comprises a base, an upright, and a swing arm, each of which is hinged to the next. Fixed to the swing arm is at least one drum head mount whereon a drum heads may be secured. Additionally, a seat assembly may be provided as an integral portion of the drum set.

Preferably, the base is H-shaped for maximum support and is adjustable so that the distance from the seat to the drum pads may be adjusted to accomodate different players and different styles of playing. A bass drum pedal is attached to the base. A locking mechanism may also be provided which will secure the upright and swing arm in a position for travel.

The hinging means which attaches the upright to the base preferably comprises a pair of gas shocks and a hydraulic door closer. The gas shocks are used to push the upright from the folded or closed position to the upright position, allowing the drum set to open or set-up automatically. The hydraulic door closer allows the set-up speed to be adjusted by means of two set screws. One of the set screws adjusts the set-up speed over approximately 80% of the range of motion while the other set screw adjusts the remaining 20%.

The swing arm assembly supports the drum heads and is rotatable so that it may fold inward to better protect the drum heads during transport. The swing arm assembly is comprised of a main tubular member inserted through preset holes in the upright and a plurality of set collars. One of the set collars is adapted to hold both a wire rope and a gas spring. The wire rope extends from the set collar to the hinging means. The gas spring is operatively attached to the set collar assembly and is connected to a medial position of the upright. As pressure is applied to the upright and it is pushed down toward the base, the tension on the wire rope increases causing the gas spring to compress. The set collar assembly can be secured in the closed position by the locking mechanism. As a result, the energy stored in the spring is not permited to be released. Once the locking mechanism is disengaged, the energy in the gas spring will be released and the swing arm assembly is pushed into the open or playing position.

The swing arm assembly may comprise more than one tubular member, each being secured to another tubular member or the upright, in order to accomodate a larger number of drum heads.

The locking means is used to secure the set in its horizontal or closed position. The locking means includes a toothed catch mounted in a locking mechanism on the support frame base. The catch is activated by a rod, running along the center portion of the H-shaped base, and having a lever integrally connected therewith. A raised rod is mounted on the upright portion of the assembly. As the drum set is pushed into the closed position, the toothed catch locks onto the raised rod. As the lever is pressed down, the rod is rotated, causing the catch mechanism to disengage the raised rod and thereby releasing the upright.

A seat assembly is provided and is pivotally attached to the support frame base by four U-bent rods. A stop leg supports the seat assembly in the open position. The seat assembly includes a seat plate having an apperature. A gas shock is attached to the stop leg and the seat plate to spring the seat into the upright position.

A seat, having a seat set collar and a seat post connected to the underside, is the only piece of the drum set which must be separately assembled to the unit upon set-up. This is accomplished by inserting the seat shaft into the apperature in the seat plate. The height of the seat can be altered by adjusting the seat set collar position.

In a preferred embodiment, the base will contain an open compartment for storage and transportation of drum sticks. This compartment may be located in the rear leg of the H-shaped base and may be formed by capping off one end of the rear leg and having a door on the opposite end. The door may be spring loaded to cause the door to close automatically. A roller rod may also be provided within the compartment for convenience in grasping the sticks. The rod is located near the door and holds the sticks away from the base of the compartment so that the sticks are easily graspable.

BRIEF DESCRIPTION OF THE DRAWINGS

These and other features of the present invention will become readily apparent upon reading the following detailed description and upon reference to the drawings in which.

DETAILED DESCRIPTION OF THE INVENTION

Figure 1:
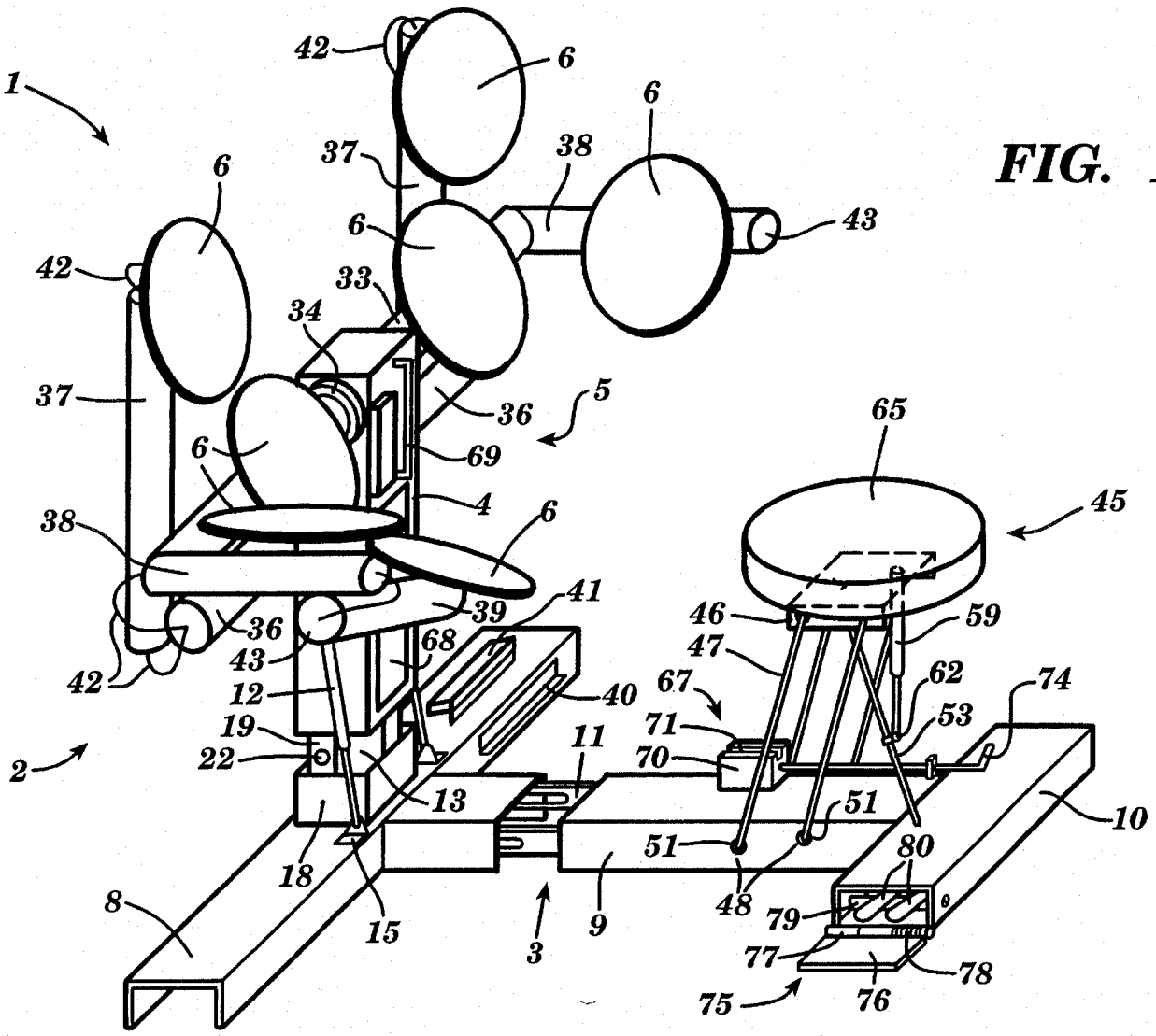
FIG. 1 is a perspective view of a collapsible, automatic set-up drum set in the upright or open position.

Referring now to the drawings, there is illustrated a collapsible, automatic set-up drum set 1 in accordance with the present invention.

As can be seen in FIG. 1, the collapsible drum set 1 is comprised of a support frame 2 having a base 3, an upright 4 and a swing arm assembly 5 with at least one drum head 6 fixedly attached thereto by means of a drum head mount (not shown).

In the preferred embodiment, for maximum support and stability, the base 3 is H-shaped, having a front leg 8, a cross piece 9 and a rear leg 10. The cross piece 9 is adjustable by means of at least one steel plate 11, which connects the H-shaped base together. The plate 11 bolts firmly to the base at one end and the other end is slotted so that shoulder bolts (not shown) can be loosened and the base can be made shorter or longer depending on player preference. As such, once the shoulder bolts are tightened, the seat assembly 45 will set-up at the same position relative to the swing arm assembly 5 consistently.

The upright 4 is hingedly or pivotally attached to the front leg 8 of the base. In the preferred embodiment, the upright 4 will be attached by a hinging means, which is shown in greater detail in FIG. 3 and in an exploded format in FIG. 4. Said hinging comprises a pair of gas shocks 12 and a hydraulic door closer 13 or other heavy duty hinge means. The gas shocks 12 operate to push the upright 4 into the upright or open position, allowing the drum set 1 to set-up or open automatically. The hydraulic door opener 13 can adjust the speed of opening by means of two set screws 14A and 14B, shown in phantom in FIG. 3. A first set screw 14A adjusts the set-up speed over approximately 80% of the range of motion, from the collapsed position to about 80% of the upright position. A second set screw 14B adjusts the speed over the remaining range of motion, between the approximately 80% open position to the fully-extended position.

Figure 3:
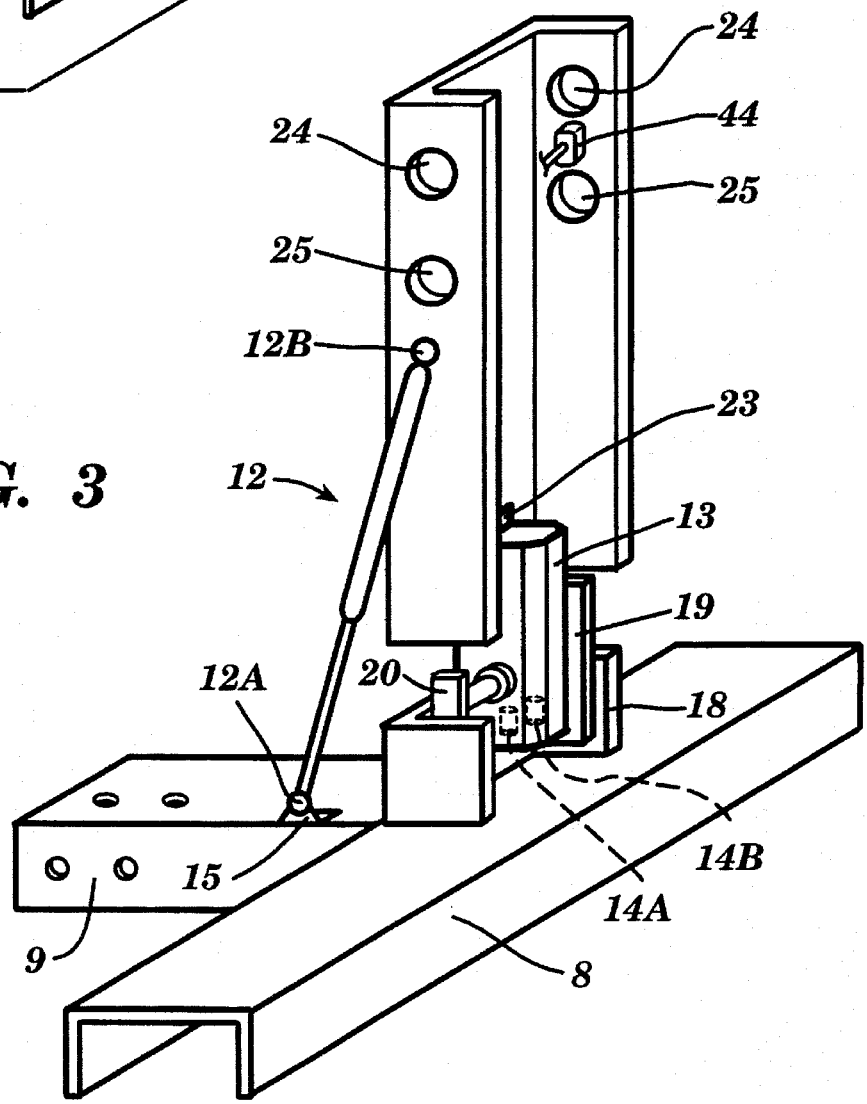
FIG. 3 is a perspective view of the hinging mechanism located between the support frame's base and upright.
Figure 7:
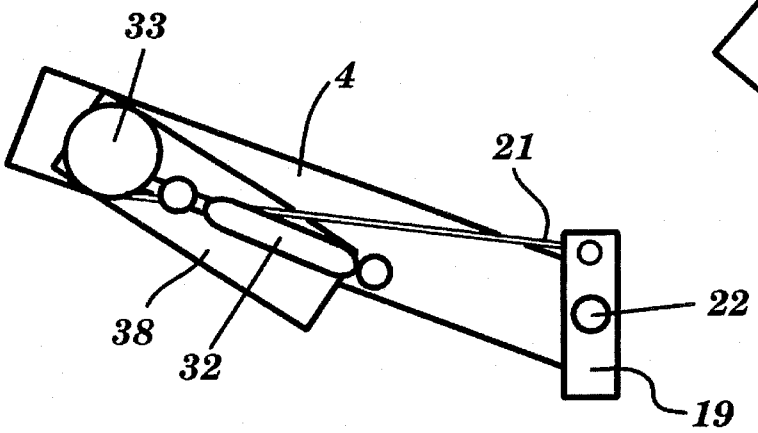
FIG. 7 is a side view of the upright and the swing arm assembly, with the swing arm in a second lowered position.
Figure 9:
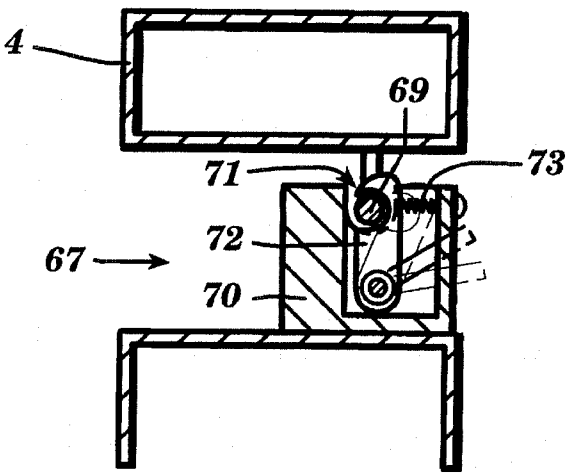
FIG. 9 is a cross sectional view along line 9—9 of FIG. 8, showing the toothed catch of the lock mechanism.
Figure 8:
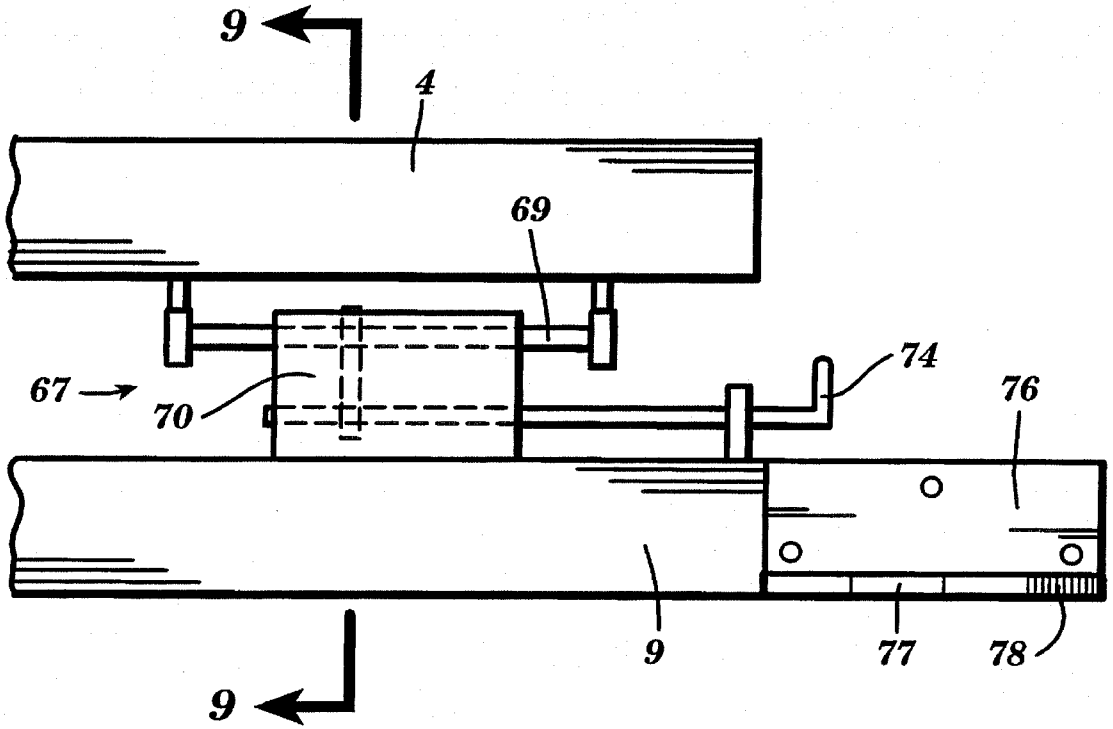
FIG. 8 is a side view of the lock mechanism, base and upright, with the upright in the collapsed or closed position.

As is shown in greater detail in FIG. 3, the hinging means comprises a pair of gas shocks 12 which are each pivotally connected at a first end 12A to an L-shaped bracket 15 which is in turn fixedly secured to the cross piece 9 of the base 3. A second end 12B of each gas shock 12 is pivotally connected to the upright 4. This connection is preferably made by bolting the gas shocks 12 to a medial position along the upright 4 by two bolts (not shown) which pass through a first pair of small apertures 17 on the upright 4. The base 3 also comprises a truncated C-beam 18 which is fixedly mounted along the front leg 8 at the place where the cross piece 9 is rigidly secured to the front leg 8. A first and a second hinge bracket, 19 and 20 respectively, are fixedly mounted to the C-beam 18. The first hinge bracket 19 extends further than the second hinge bracket and is adapted to receive a wire rope 21 from the swing arm assembly 5 above the hinge center line 22 as shown in FIG. 7.

As shown in FIG. 3, the hydraulic door closer 13 is pivotally mounted between the first and second hinge brackets, 19 and 20, respectively. A plate 23 extends from the top end of the hydraulic door closer 13 and provides an area for securing the hydraulic door closer 13 to the upright 4.

Figure 4:
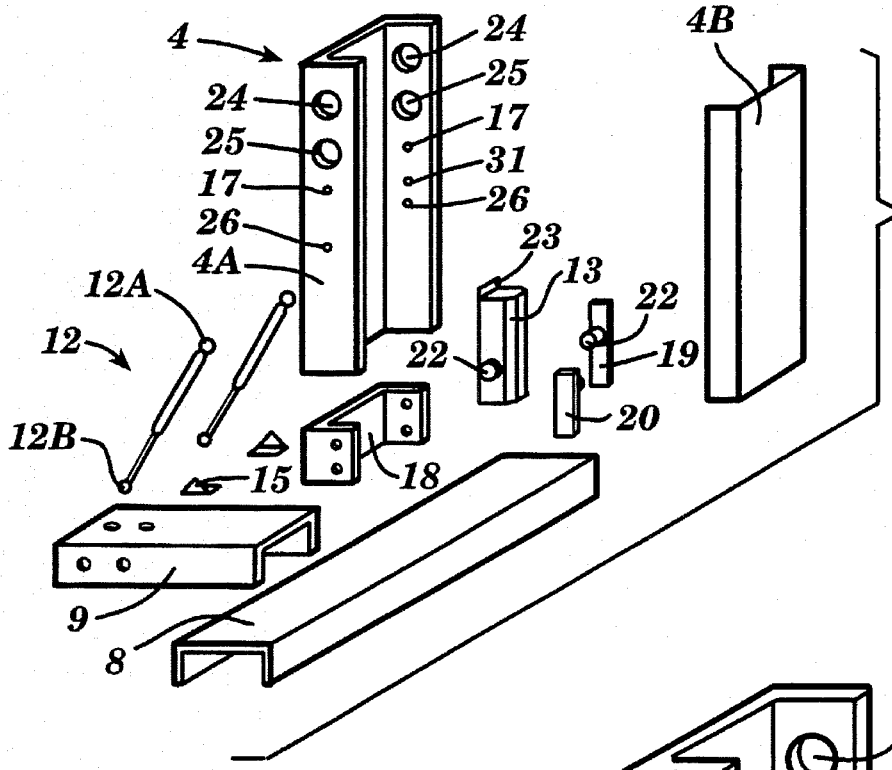
FIG. 4 is an exploded view of the hinging mechanism, the base and the upright.
Figure 13:
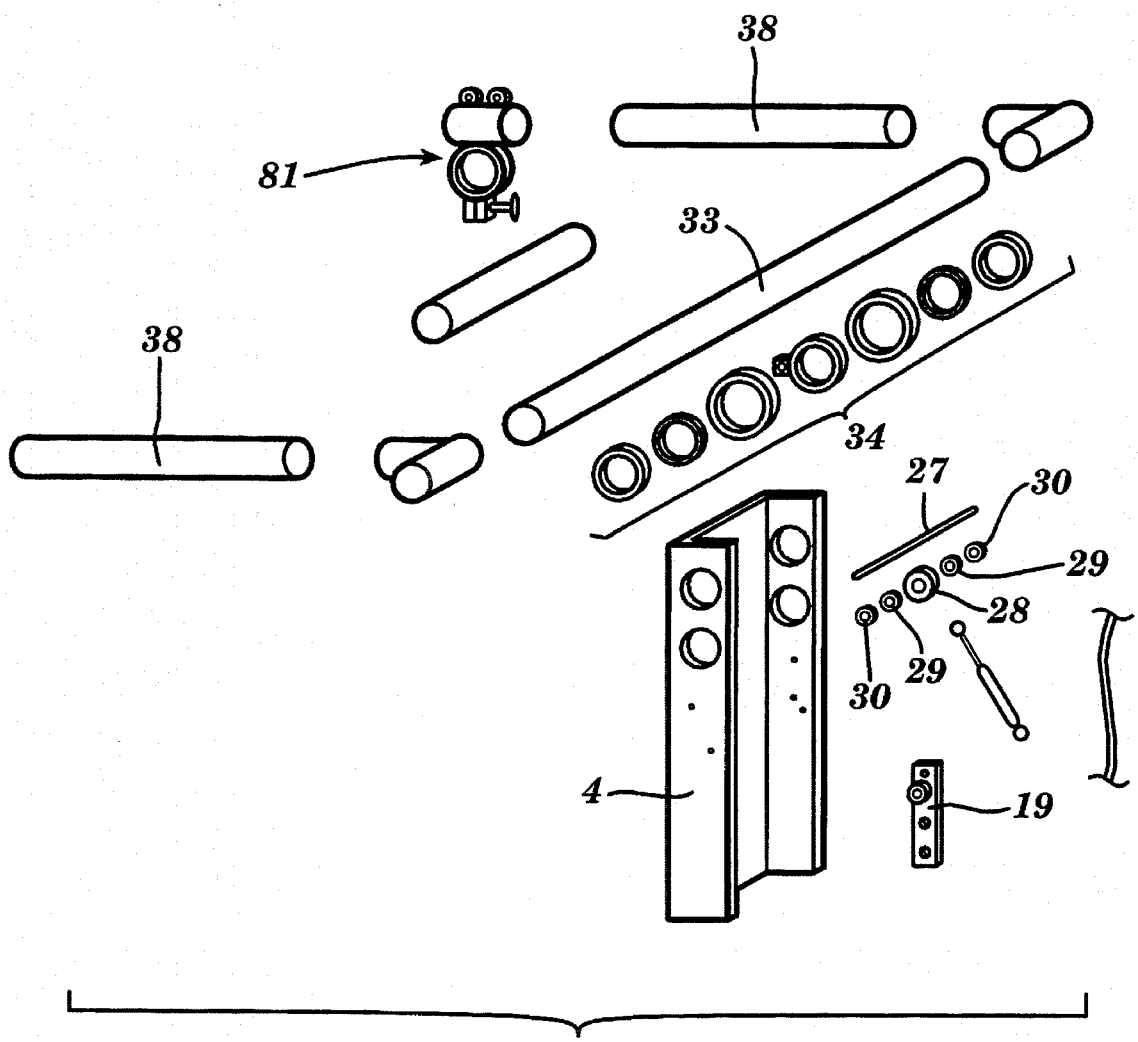
FIG. 13 is an exploded view of the swing arm assembly and upright.

As shown in FIGS. 4 and 13, the upright 4 preferably comprises a weight-bearing, functional portion 4A and a face plate 4B. The face plate 4B serves merely to protect the inner workings and to present a better looking structure. The functional portion 4A includes a plurality of apertures. In the most preferred embodiment, there are two pairs of large apertures, an upper pair 24 and a lower pair 25. The upper pair of large apertures 24 serves as the primary support for the swing arm assembly 5. The lower pair of large apertures serve as the secondary support for the swing arm assembly 5. A second pair of small apertures 26 supports a thin tube 27. The thin tube 27 has a wire guide 28 around it which is held in place by a first pair of small set collars 29. The thin tube 27 is held in place by a second pair of small set collars 30. A single aperture 31 functions as a site for pivotally attaching a lowered 32A of a swing arm gas spring 32.

Figure 2:
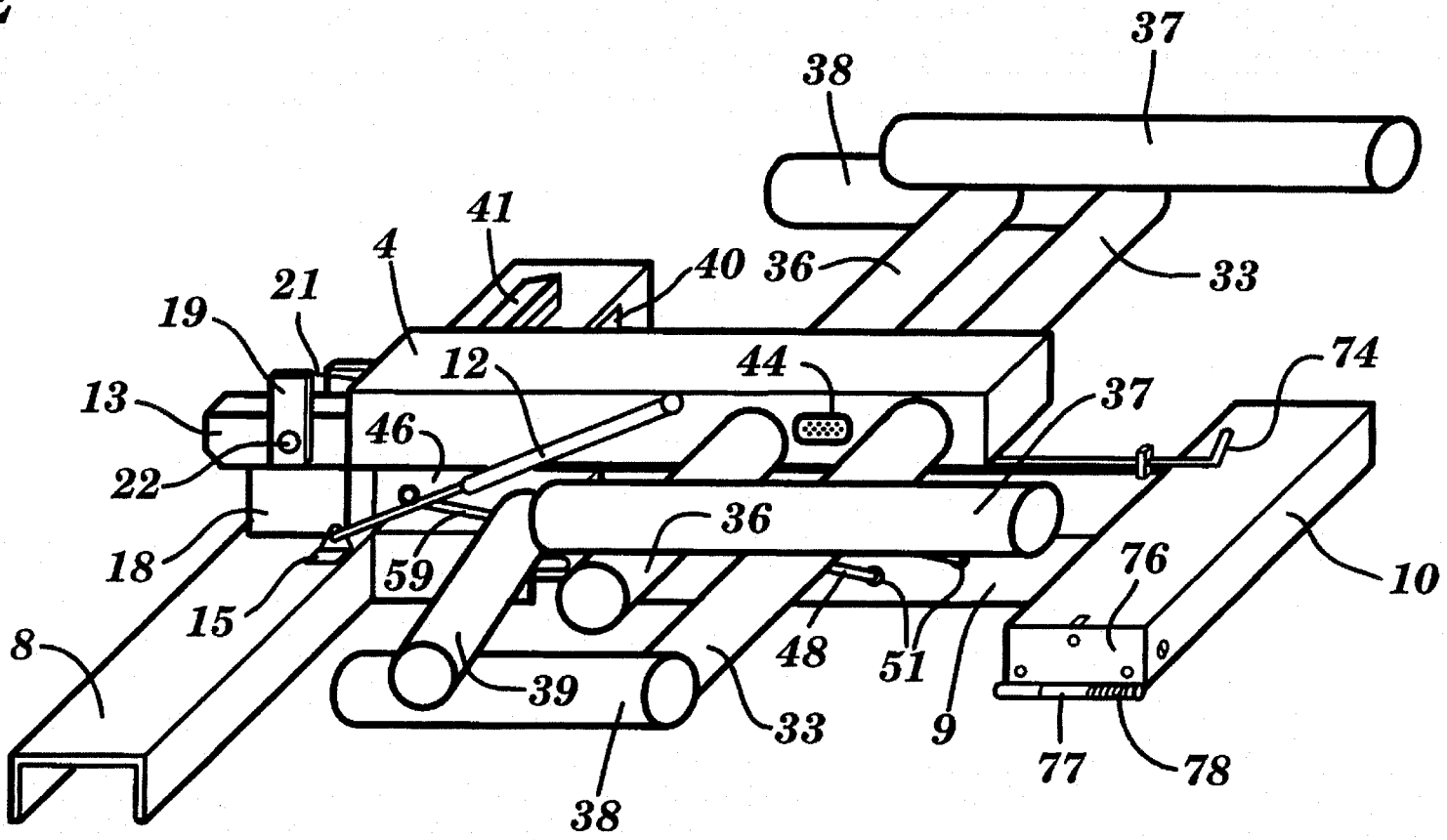
FIG. 2 is a perspective view of a collapsible, automatic set-up drum set in the collapsed or closed position.
Figure 5:
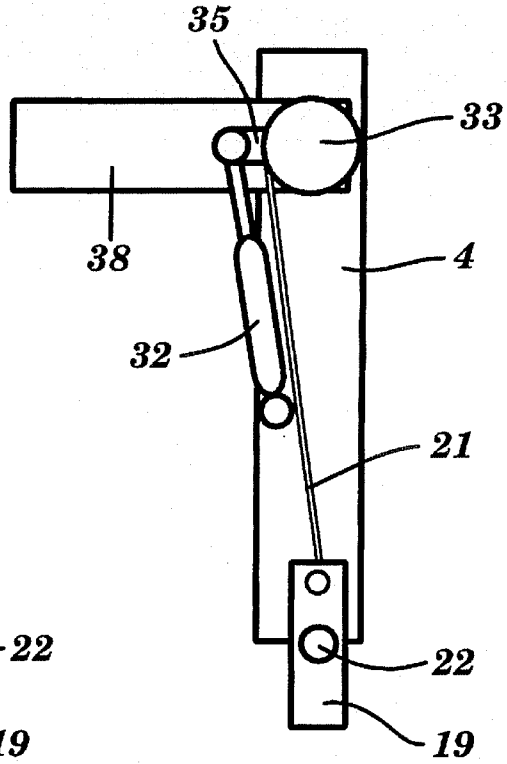
FIG. 5 is a side view of the upright and the swing arm assembly in the set-up position.
Figure 6:
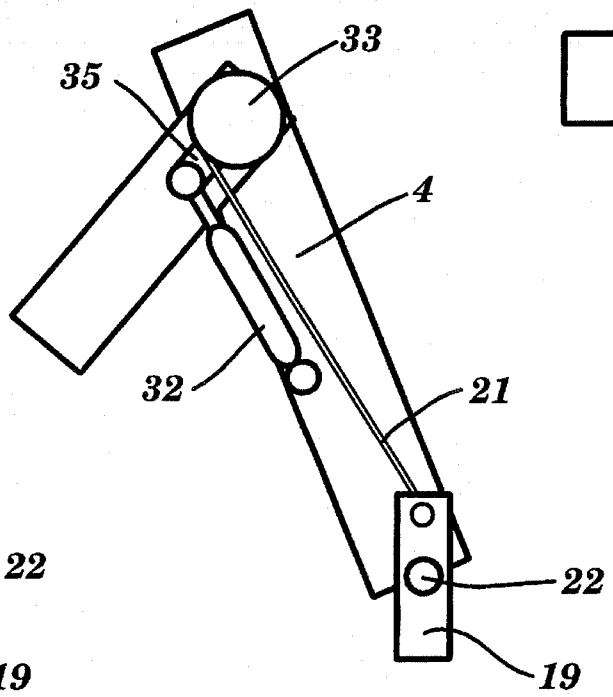
FIG. 6 is a side view of the upright and the swing arm assembly, with the swing arm in a first lowered position.

The swing arm assembly 5 is comprised of a main tubular member 33 which extends through the upper pair of large apertures 24 of the upright 4, as shown in FIG. 13. A plurality of set collars 34 hold the main tubular member 33 in place. Additionally, a specially adapted set collar 35 extends around the main tubular member 33. This specially adapted set collar is modified to hold the wire rope 21 and an upper end 32B of the swing arm gas spring 32. The wire rope 21, specially adapted set collar 35, and swing arm gas spring 32 work in conjunction to rotate the main tubular member 33 so that the drum head(s) 6 are somewhat protected and out of the way when the drum set 1 is in the collapsed position as shown in FIG. 2 and so that the drum head(s) 6 are in the playing position when the drum set 1 is in the set-up position as shown in FIG. 1. The motion of the swing arm assembly 5 relative to the upright is shown in FIGS. 5, 6, and 7.

The swing arm assembly 5 may additionally comprise at least one secondary tubular member as shown in FIGS. 1 and 13. In the preferred embodiment, the main tubular member 33 extends horizontally. A pair of first secondary tubular members 36 extending parallel to the main tubular member 33, each through the respective side of the lower pair of large apertures 25 of the upright 4, are attached thereto. For additional support the opposite end of the first secondary tubular members 36 may be loosely clamped proximate the far end of the main tubular member 33 so that the main tubular member 33 may rotate without the first secondary tubular member 36 rotating as well.

At least one upright, secondary tubular member 37 may be secured to the first secondary tubular members 36 or they may form an integral portion of a "tubing network" with the first secondary tubular members 36. An example of a possible clamping member 81 for attaching tubular members in perpendicular relationship to each other is shown in FIG. 13. It is preferable that the upright tubular members 37 be attached to the first secondary tubular members 36 rather than the main tubular member 33 so that they do not rotate when the drum set is collapsed.

At least one forward-extending tubular member 38 may be clamped or otherwise attached proximate the far end of the main tubular member 33 to support additional drum heads 6. From the forward-extended tubular members 38, at a distance from the main tubular member 33, a horizontal secondary tubular member 39 may be attached to support another drum head 6. This is regularly attached on the left side of the seated drummer in order to conform with standard drum sets, but may be located wherever the individual prefers.

Also, a bass drum pedal (not shown) may be mounted to the front leg 8 of the base 3. A bass pedal mounts 40 and a bass drum trigger pad 41 are shown in FIGS. 1 and 2.

In the case of electric drum sets, a wire 42 extends from each of the piezo elements (not shown) on the drum heads 6 to a trigger-to-MIDI converter or drum sound module (not shown). To prevent the damage and dislocation of these wires 42 as much as possible, the wires 42 are preferably run through the tubing as much as possible. Therefore holes (not shown) may be provided through the tubing that are of adequate diameter to allow the wires 42 to be passed to the interior of the tubing 43 and through the first secondary tubular members 36 into the upright 4 to which a plug unit 44 may be attached for electrical connection of the electric drum heads 6 to the trigger-to-MIDI converter (not shown) and a power supply (not shown). Alternatively, the trigger-to-MIDI converter may be incorporated into the drum set 1 itself and would function as the plug unit 44.

Figure 10:
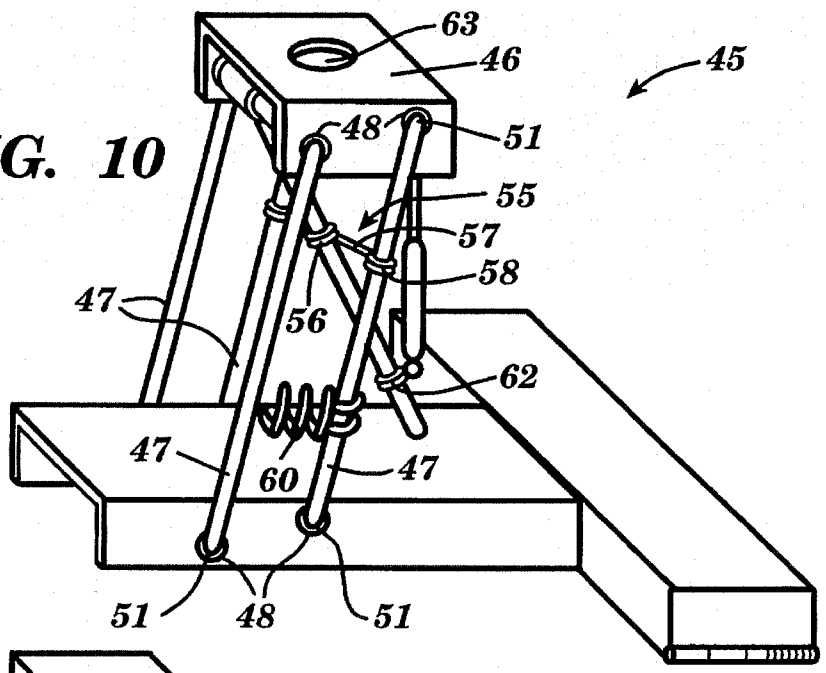
FIG. 10 is a perspective view of a portion of the base and the seat assembly.
Figure 12:
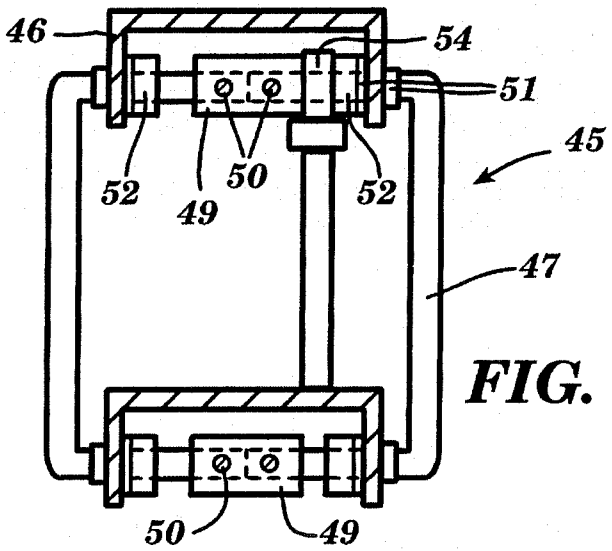
FIG. 12 is a cross sectional view along line 12—12 of FIG. 10, showing the U-bent rods, the stop leg and the hinge.
Figure 11:
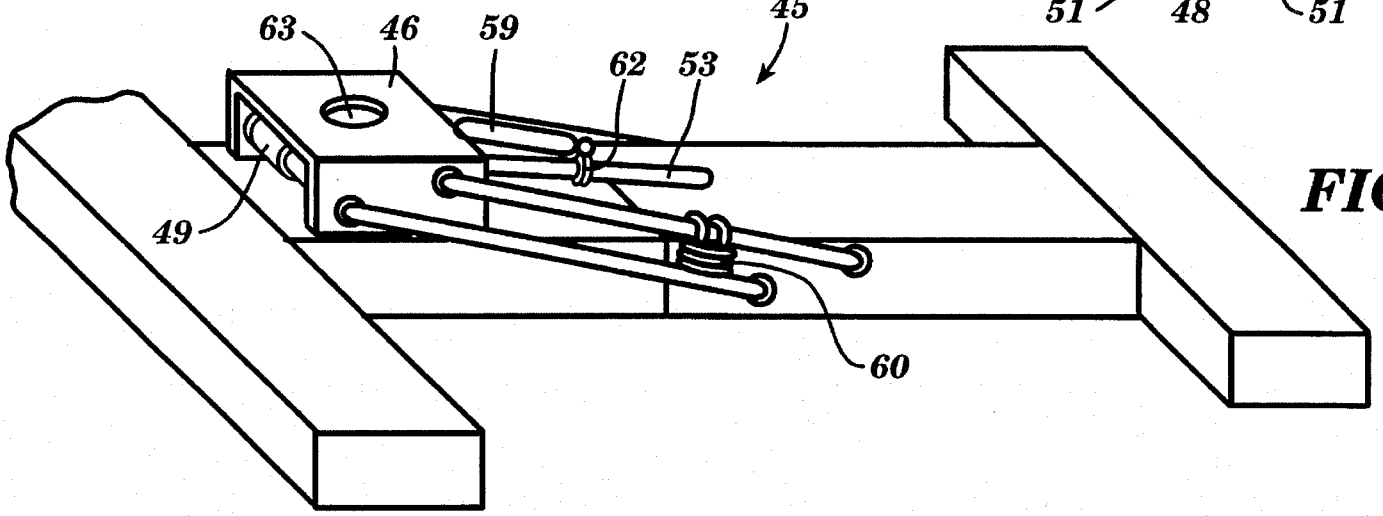
FIG. 11 is a cut away perspective view of the base and the seat assembly in the collapsed or closed position.

A seat assembly 45 may also be provided if it is desired. The seat assembly 45 may also be a collapsible, automatic set-up. One possible embodiment of an automatic set-up, collapsible seat assembly 45 is shown in FIGS. 10–12. FIG. 10 shows the preferred seat assembly 45 in the upright or open position and FIG. 11 shows the preferred seat assembly 45 in the folded or closed position.

The seat assembly 45 preferably comprises a seat plate 46, which is a C-beam portion, a plurality of U-shaped rods 47, which are fed through offset apertures 48 in the cross piece 9 of the base 3 and the seat plate 46, so that the seat plate 46 is always parallel to the base 3, two shaft couplings 49 per pair of U-shaped rods 47 to connect the distal ends of the U-shaped rods 47 to each other, two coupling set screws 50 per shaft coupling 49 to hold the U-shaped rods 47 securely within the shaft couplings 49, and a nylon bushing 51 and a shaft collar 52 which combinedly function to hold the U-shaped rods 47 rotatable within the offset apertures 48 as shown in FIG. 12.

A stop leg 53 is provided to hold the seat plate 46 at a distance from the base 3. The top of the stop leg 53 may be pivotally attached to the upper distal end of one of the front pair of U-shaped rods 47 by a stop leg hinge 54. The stop leg 53 is held in position by a guide 55. The guide 55 comprises a main collar 56 which encircles the stop leg 53 and is held in place by a main collar set screw (not shown). The main collar 56 is attached to a pair of guide wires 57 which extend from the main collar 56 at approximately 180° from each other. The guide wires 57 are each attached at an opposite end to a secondary collar 58 which slidably encircles one of the U-shaped rods 47.

In order to have the seat assembly 45 be automatic set-up, a seat gas spring 59 is provided. Additionally, an assist spring 60 may be provided to get the seat assembly 45 started into motion when the drum set 1 has been collapsed for an extended period of time.

The seat gas spring 59 is pivotally attached to the gas spring hinge 61 which encircles the upper distal end of one of the rear pair of U-shaped rods 47. The opposite end of the seat gas spring 59 is connected proximate the bottom of the stop leg 53 by means of a bracketed collar 62.

The seat plate 46 additionally comprises a large aperture 63 adapted to slidably receive a seat post (not shown) of a cushioned seat 65. For the adjustability of the height of the seat 65, a seat set collar (not shown) may be provided which would have an inner diameter to encircle the seat post and an outer diameter greater than the diameter of the large aperture 63. The seat set collar could then be tightened down along the seat post at the appropriate height so that when the seat post is slid through the large aperture 63, the seat set collar will catch and hold the cushioned seat 65 at a distance from the seat plate 46.

The entire drum set 1 is collapsible and may be automatically set-up by the various gas springs/shocks 12, 32, 59. In order to hold these springs/shocks 12, 32, 59 in the compressed position as shown in FIG. 2, a locking mechanism 67 is also provided. To collapse the drum set 1, the seat assembly 45 is pushed downward and forward so that the seat plate 46 fits over the cross piece 9 near the front leg 8. The seat assembly 45 is held in a closed or partially closed position manually while the upright 4 is pushed downward on top of the seat assembly 45. Optionally, the upright 4 may be provided with a scratch pad 68 of teflon or a dense plastic so that the seat assembly 45 may slide along the upright 4 as both are being pushed downward without wearing or gouging the material of the upright 4 or the seat plate 46. A raised rod 69 is provided on the upright 4. A locking mechanism 67 is provided on the cross piece 9 of the base 3. The locking mechanism 67 preferably includes an encasement 70 which surrounds the inner workings of the locking mechanism 67 but provides a trough 71 for receiving the raised rod 69. A toothed catch 72 locks the raised rod 69 by a spring-loaded mechanism 73. An L-bent foot lever 74 is connected to the toothed catch 72 and serves to disengage the toothed catch 72 from the raised rod 69 when rotated by pushing the toothed catch 72 against the spring-loaded mechanism 73. When pressure is released from the L-bent foot lever 74, the toothed catch 72 springs back into position.

As a further convenience, a stick compartment may be built into the rear leg 10 of the base 3 by providing a door 76 attached to an edge of the rear leg 10 which is hollow. The door 76 is attached to the rear leg by a hinge 77 and a spring 78 or a latching device (not shown) so that the door 76 will stay closed when the drum set 1 is being transported. Additionally, a roller rod 79 may be provided to support the drum sticks 80 away from the bottom of the stick compartment 75 for better graspability. Also for convenience, a handle (not shown) may be connected on the base 3 or the upright 4 for easier carrying in transport.

While the invention has been particularly shown and described with reference to preferred exemplary embodiments thereof, it will be understood by those skilled in the art that changes in form, such as the shape of the base, the placement of the drum heads tubular members, the stick compartment and locking mechanism, and the number of plates for adjustment of the length of the cross piece, and details such as the materials and means to connect pieces, e.g. the tubular members may be welded, brazed, or soldered together, may be made therein without departing from the spirit and scope of the invention.

I claim:

1. A method for operation of a collapsible drum set comprising:

providing a drum set including a base, at least one support, and a plurality of drums attached to said support, wherein said support is hingedly attached with respect to said base;

providing a seat support, hingedly attached to said base;

adjusting the positioning of said base, support, and drums;

adjusting the positioning of said seat support;

collapsing said seat support toward said base for storage and/or transportation;

collapsing said support toward said base for storage and/or transportation; and automatically reassembling said drum set and said seat support to said previously adjusted position.

2. The method of claim 1, further comprising the step of:

attaching a seat to said seat support.

3. The method of claim 1, wherein said drums are electronic.

4. A method for operation of a collapsible drum set comprising:

providing a drum set including a base, at least one support, and a plurality of drums attached to said support, wherein said support is hingedly attached with respect to said base;

adjusting the positioning of said base, support, and drums;

collapsing said support toward said base for storage and/or transportation; and automatically reassembling said drum set to said previously adjusted position, wherein said drums are electronic.

5. A collapsible drum set comprising:

a base;

at least one support, hinged with respect to said base; and at least one drum attached to said support, wherein said base and said drum hingedly collapses with respect to said base for transportation and/or storage, further comprising:

a seat support hinged with respect to said base, wherein said seat support hingedly collapses with respect to said base for transportation and/or storage.

6. The collapsible drum set of claim 5, wherein said base is H-shaped.

7. The collapsible drum set of claim 6, wherein said base includes a storage compartment having a size for storing drum sticks.

8. The collapsible drum set of claim 5, wherein said support further comprises a swing arm for mounting said drum.

9. A collapsible drum set comprising:

a base;

at least one support, hinged to said base; and a plurality of drums attached to said support, wherein said base and said drums hingedly collapse upon said base for transportation and/or storage, further comprising means, operatively attached between said base and said support, for automatically assembling said drum set.

10. The collapsible drum set of claim 9, wherein said means for automatically assembling further comprises at least one gas spring and one wire rope.

11. A collapsible drum set comprising:

a base;

at least one support, hinged to said base; and a plurality of drums attached to said support, wherein said base and said drums hingedly collapse upon said base for transportation and/or storage, wherein said drums are electronic.

* * * * *